US005532666A

United States Patent [19]

Leupold

[11] Patent Number: 5,532,666

[45] Date of Patent: Jul. 2, 1996

[54] MAGNETOSTATIC CHARGED PARTICLE TRAP

[75] Inventor: Herbert A. Leupold, Eatontown, N.J.

[73] Assignee: The United States of America as represented by the Secretary of the Army, Washington, D.C.

[21] Appl. No.: 454,965

[22] Filed: May 31, 1995

[51] Int. Cl.[6] ..... H01F 7/02

[52] U.S. Cl. ..... 335/306

[58] Field of Search ..... 335/302, 301, 335/306

[56] References Cited

U.S. PATENT DOCUMENTS 5,216,400 6/1993 Leupold .
5,216,401 6/1993 Leupold ..... 335/306
5,396,209 3/1995 Leupold .

*Primary Examiner*—Brian W. Brown
*Assistant Examiner*—Ramon M. Barrera
*Attorney, Agent, or Firm*—Michael Zelenka; William H. Anderson

[57] ABSTRACT

A charged particle trap having a spherical shell of magnetic material and a spherical hollow cavity positioned concentrically within the shell. A polar axis passes through the center of the shell and cavity. The shell is permanently magnetized to produce a double-tapered magnetic field having barrel-shaped flux lines that are concentrated at the cavity poles. The magnetic material has a remanence $B_r(\theta)$ that varies in direction and magnitude such that its angular orientation $\alpha$ with respect to the polar axis varies as a function of the polar angle $\theta$ of the material's average location in accordance with the equation $\alpha=2\theta$. The magnitude of the remanence $B_r(\theta)$ varies according to the following expressions: $B_r(\theta)=B_r(0)\ [B_r(\pi/2)-B_r(0)]\ 2\theta/\pi$, for average polar angles between $\theta=0$ radians and $\theta=\pi/2$ radians; and $B_r(\theta)=B_r(\pi/2)\ [B_r(\pi/2)-B_r(0)]\ (2\theta-\pi)/\pi$, for average polar angles between $\theta=\pi/2$ radians and $\theta=\pi$ radians. An equatorial access port passes through the shell and communicates with the cavity. Charged particles entering the cavity via the access port will normally be deflected by the magnetic field into helical paths about the flux lines. As these particles approach the cavity poles, concentrated magnetic fields will cause them to spiral into ever-tightening helixes until they are reflected back into the central region of the cavity where the process repeats.

4 Claims, 1 Drawing Sheet

MAGNETOSTATIC CHARGED PARTICLE TRAP

GOVERNMENT INTEREST

The invention described herein may be manufactured, used and licensed by or for the Government for governmental purposes without the payment to me of any royalties thereon.

BACKGROUND OF THE INVENTION

1. Field of the Invention

This invention relates in general to the field of permanent magnet devices. More particularly, the invention relates to magnetic bottles that function as magnetostatic traps for charged particles.

2. Description of the Prior Art

Magnetostatic traps of the magnetic-bottle variety have been used to confine ions and other charged particles that are too hot or too cold to be permitted to interact with the walls of a container vessel, or that would react violently with them. For example, some magnetic bottles hold dense hot plasmas of isotopes for nuclear interactions. Other magnetic bottles store isolated ion or atomic systems at extremely low temperatures.

The operation of magnetic bottles is based on the principle that a charged particle with velocity perpendicular to the bottle's magnetic field lines travels in a circle, whereas a particle moving parallel to the field is unaffected by it. In general, such particles have velocity components both parallel and perpendicular to the field lines and, therefore, move in helical spirals.

One well known type of magnetic bottle confines particles therein through the use of magnetic mirrors, i.e., regions at opposite ends of the bottle where magnetic fields increase abruptly in strength. As a particle approaches these ends, the concentrated magnetic fields cause it to spiral into ever-tightening helixes. Essentially, these concentrated fields act as magnetic mirrors by reflecting the charged particles back into the central region of the bottle where the process is repeated. More specifically, the time-averaged circular motion of a confined particle effectively acts as a current loop with an associated magnetic moment that the gradient of the magnetic bottle field repels.

In prior art apparatus, the size of a magnetic bottle usually varies inversely with the strength of its magnetic field. In general, the greater the strength of the magnetic field, the smaller the region in which the particles can be trapped. Those concerned with the development of charged particle devices, such as plasma gas discharge tubes, plasma display devices and free-electron lasers, have recognized the need for improved compact magnetic bottles capable of confining particles in relatively small regions. Such compact magnetic bottles are also especially suitable for operation in confined spaces where weight and size pose serious problems, such as in aircraft, submarines, missiles and ballistic devices.

One of the most critical problems confronting designers of compact magnetic bottles has been the fabrication of permanent magnets capable of generating gradient magnetic fields of high intensity in a structure having a minimum of mass and bulk. Ideally, such compact magnetic structures must also be inexpensive to manufacture, and be sufficiently stable to operate reliably under adverse conditions such as high temperatures and accelerations.

SUMMARY OF THE INVENTION

It is therefore an object of the present invention to provide a permanent-magnet flux source having a working field that functions as a magnetic bottle for charged particles.

Another object of the invention is the provision of compact magnetic bottles formed from permanent magnets capable of generating gradient magnetic fields of high intensity in a structure having a minimum of mass and bulk.

To attain this, the present invention contemplates a unique permanent magnet having a shell of magnetic material and a hollow cavity. The shell is permanently magnetized to produce an axially double-tapered, barrel-shaped magnetic field in the cavity.

In general, the present invention includes a segmented spherical magnetic shell having a concentric spherical cavity. An access port passes through equatorial segments of the shell. The shell ("magic sphere") is magnetized such that it is capable of producing a double-tapered magnetic field having barrel-shaped flux lines in its cavity. The shell material has a magnetic remanence that varies in magnitude and direction as a function of the polar angle.

More specifically, the invention is directed to a charged particle trap having a segmented spherical shell of magnetic material and a spherical hollow cavity positioned concentrically within the shell. A polar axis passes through the center of the shell and cavity. The shell is permanently magnetized to produce a double-tapered magnetic field having barrel-shaped flux lines that are concentrated at the cavity poles. The magnetic material has a remanence that varies in direction and magnitude from segment-to-segment as a function of the average polar angle of its segment. An equatorial access port passes through the shell and communicates with the cavity. The magnetic field deflects charged particles entering the cavity via the access port into helical paths. As these particles approach the cavity poles, they are reflected back into the central region of the cavity where the process repeats.

BRIEF DESCRIPTION OF THE DRAWINGS

Other objects, features, details, advantages and applications of the invention will become apparent in light of the ensuing detailed disclosure, and particularly in light of the drawings wherein.

DETAILED DESCRIPTION OF THE PREFERRED EMBODIMENT

Figure 1:
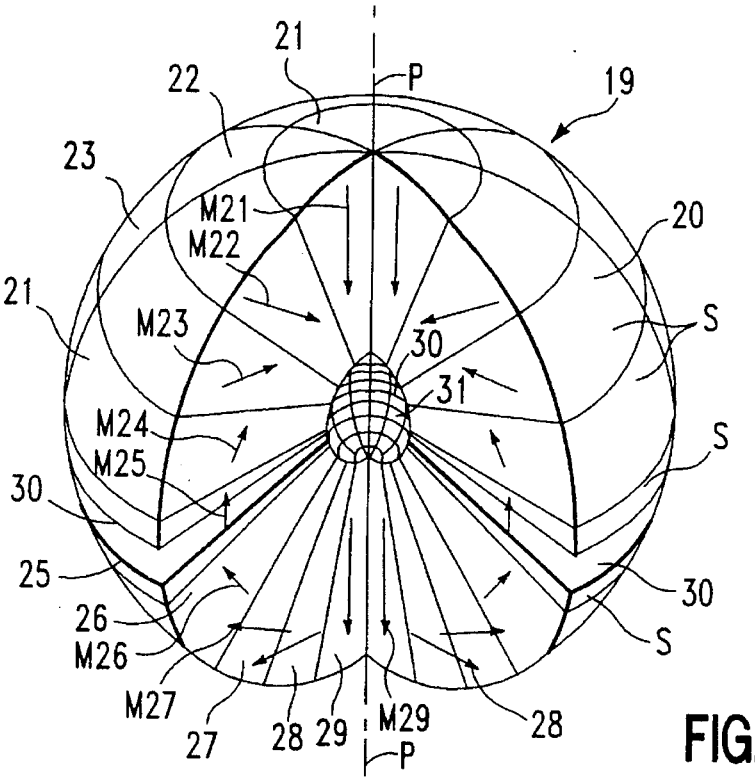
FIG. 1 is a break-away pictorial representation of a preferred embodiment of the invention.

Referring now to the drawings, there is shown in FIG. 1 a segmented, high-field "magic-sphere" type permanent magnet 19 having a spherical shell 20 and a spherical cavity 31 concentrically arranged with infinite-fold symmetry about polar axis P. U.S. Pat. No. 5,216,400, entitled "Magnet Field Sources for Producing High-Intensity Variable Fields," describes a conventional "magic-sphere" type permanent magnet.

Spherical shell 20 is formed from an assembly of eighty nested magnetic segments S, each of which has a uniform magnetization, i.e., the magnetization in each segment S is constant in both magnitude and direction. Segments S form a series of nested cones 21–29 having a common conical axis that is concentric with polar axis P. The equatorial region of spherical shell 20 includes equatorial access port 30 that separates the sixteen segments S that form equatorial cone 25.

The FIG. 1 illustration depicts magnet 19 in pictorial form with twenty segments S omitted to reveal the shapes of segments S, cones 21–29, equatorial access port 30 and cavity 31. FIG. 1 also includes a series of magnetization vectors M(21)–M(29) which represent the uniform magnetization of segments S in each of cones 21–29, respectively. In this regard, while the magnetization of each segment S is uniform and the magnetization of the segments S that form a particular cone are identical to each other, the magnetization from cone-to-cone varies in a manner that will become clear from the ensuing description.

Figure 2:
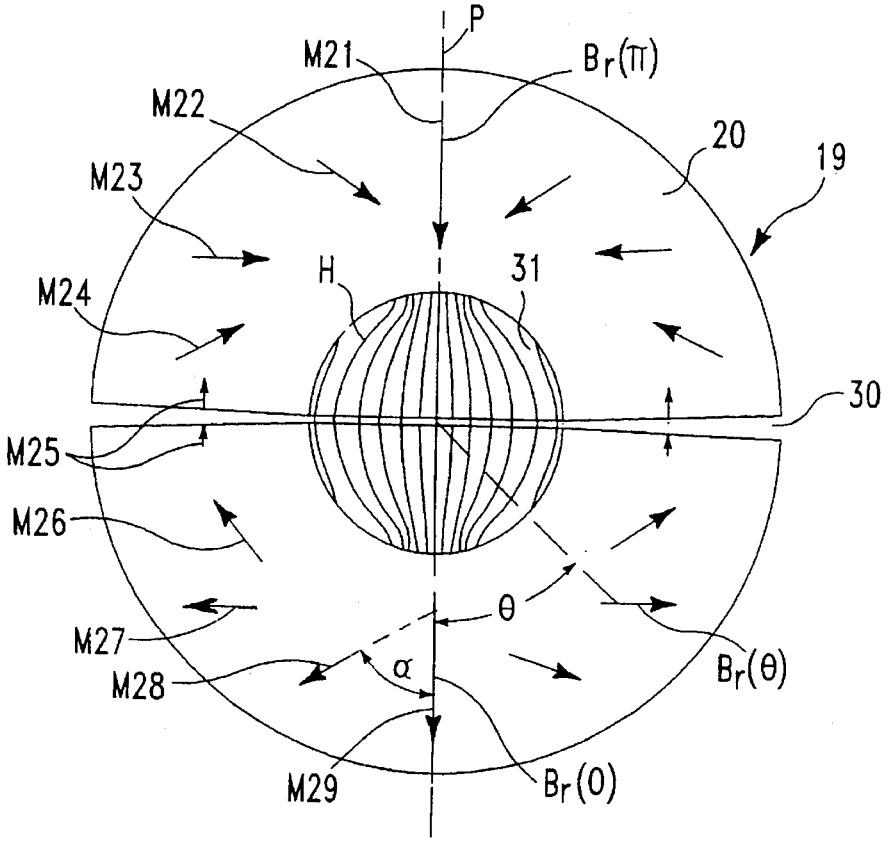
FIG. 2 is a schematic representation of the FIG. 1 device showing a bisecting cross sectional elevation.

FIG. 2 is an elevation view that schematically illustrates a hemispherical section of magnet 19 with spherical cavity 31 slightly enlarged. FIG. 2 also shows the magnetic lines of flux for working magnetic field H contained in cavity 31. Magnetic field H, which has flux lines that are shaped like a barrel due to magnetic segments S, forms a magnetic bottle with opposed magnetic mirrors at the polar regions of cavity 31.

More specifically, magnetic field H has regions of concentrated flux lines at opposite polar ends of cavity 31. By contrast, the flux lines near the equatorial region of cavity 31 are significantly less concentrated and, therefore, spread out to form a barrel-shaped magnetic field H. Consequently, charged particles entering cavity 31 via access port 30 will normally be deflected by magnetic field H into helical paths about the flux lines. As these particles approach the polar ends of cavity 31, the concentrated magnetic fields H will cause them to spiral into ever-tightening helixes until they are reflected back into the central region of cavity 31 where the process is repeated.

In more analytical terms, it is generally known that an ion beam traveling in a uniform magnetic field with a lateral component of velocity will travel in a helix of radius $r=mc/He$, where H is the field strength in oersteds, c is the velocity of light in centimeters per second, and m and e are the ionic mass and charge, respectively. If the ion is positively charged, the helical rotation will be counter clockwise as viewed in the direction of the field while that of a negative ion, such as an electron, would have a clockwise rotation. Thus the ion's lateral motion would be confined to an area of radius r. Clearly, the above equation for radius r shows that the larger the magnetic field H, the smaller will be the radius r for a given lateral velocity and the better will be the focus. If the axial component of the magnetic field H tapers such that it grows smaller or larger with progression along the axis, the ion will be pushed axially away from the region of higher magnetic field H. With a proper tapering of the magnetic field H to obtain the barrel-shaped flux lines of FIG. 2, the ion will effectively be trapped.

In the present case, the magnetization vectors M(21) and M(29) at the polar segments S that form polar cones 21 and 29 are equal in size and direction. More specifically, magnetization vectors M(21) and M(29) are parallel to polar axis P and point in the same downward direction as seen in FIG. 2. The remaining magnetization vectors M(22)–M(28) vary in both magnitude and direction as a function of the average polar angle θ of its segment. Consequently, the resulting magnetic field H appropriately tapers toward and becomes concentrated at the cavity poles to obtain the barrel-shaped field configuration illustrated in FIG. 2. The size of magnetization angles α with respect to polar axis P of magnetization vectors M(22)–M(28) varies as a function of average polar angle θ such that $\alpha=2\theta$. The magnitudes of magnetization vectors M(21)–M(29) vary from a maximum value at the poles to a minimum value at the equator. This variation is achieved by varying the remanence $B_r$ of magnetic segments S as a function of their average polar angle θ according to the following expressions for remanence $B_r(\theta)$:

$B_r(\theta)=B_r(0)\ [B_r(\pi/2)-B_r(0)]\ 2\theta/\pi$, for average polar angles between $\theta=0$ radians, and $\theta=\pi/2$ radians; and $B_r(\theta)=B_r(\pi/2)\ [B_r(\pi/2)-B_r(0)]\ (2\pi-\pi)/\pi$, for average polar angles between $\theta=\pi/2$ radians and $\theta=\pi$ radians.

Obviously many modifications and variations of the present invention are possible in the light of the above teachings. For example, the ideal "magic sphere" would not be segmented as shown in the present preferred embodiment. Ideally, the "magic sphere" would be a one-piece structure in which the magnitude and direction of its magnetization varies continuously. However, since fabrication of an ideal "magic sphere" is not reasonably feasible, a segmented approximation is used. In the segmented configuration, the magnetization is substantially constant in both magnitude and direction within any one segment. Consequently, the more segments used, the more the final structure will approximate the ideal "magic sphere." Fortunately, with the preferred embodiment, in which only eighty segments S as used, more than 90 percent of the field of an ideal structure is obtainable.

Additionally, the inventive technique may be readily applied to a variety of other flux sources that have a shell of magnetic material and an inner cavity. However, those skilled in these arts will recognize from the above teachings that the "magic-sphere" type structure of the preferred embodiment provides a particle trap capable of generating high-intensity magnetic fields in a structure having a minimum of mass and bulk. Consequently, the particle trap of the present invention will be relatively inexpensive to manufacture and highly stable under adverse operating conditions such as high temperatures and accelerations.

What is claimed is:

1. A charged particle ion trap comprising a shell of magnetic material having a hollow cavity and an access port that communicates with said cavity, said shell being permanently magnetized such that its magnetization produces a tapered magnetic field in said cavity; wherein said shell and said cavity are concentric spheres having spherical center, opposite poles, an equatorial region and a polar axis that passes through said center and said poles, and said magnetization of said magnetic material has a remanence $B_r$ that is a maximum at said poles and decreases to a minimum at said equatorial region; wherein said access port is located at said equatorial region; wherein said shell comprises a plurality of magnetic segments and each segment is uniformly magnetized; wherein said magnetization of said segments at said poles is oriented in the same direction and parallel to said polar axis; wherein the magnetization angle with respect to said pole is twice the average polar angle of said segments; and wherein the magnitude of said remanence $B_r$ of said material is a function of said average polar angle (θ) according to the following expression:

$B_r(\theta)=B_r(0)\ [B_r(\pi/2)-B_r\ (0)]\ 2\theta/\pi$, for average polar angles between $\theta=0$ radians and $\theta=\pi/2$ radians; and $B_r(\theta)=B_r(\pi/2)\ [B_r(\pi/2)-B_r(0)]\ (2\theta-\pi)/\pi$, for average polar angles between $\theta=\pi/2$ radians and $\theta=\pi$ radians.

2. A charged particle ion trap comprising a spherical shell of magnetic material having a spherical hollow cavity positioned concentrically within said shell and having a polar axis that passes through a center of said shell and cavity, said shell being permanently magnetized to produce a double-tapered magnetic field in said cavity, wherein said magnetic material has a remanence that varies in direction and magnitude such that the angular orientation $\alpha$ of said remanence with respect to said polar axis varies as a function of a polar angle $\theta$ of the material's average location in accordance with with equation $\alpha=2\theta$; wherein the remanence $B_r(\theta)$ varies according to the following expression:

$B_r(\theta)=B_r(0)\ [B_r(\pi/2)-B_r\ (0)]\ 2\theta/\pi$, for average polar angles between $\theta=0$ radians and $\theta=\pi/2$ radians; and $B_r(\theta)=B_r(\pi/2)\ [B_r(\pi/2)-B_r(0)]\ (2\theta-\pi)/\pi$, for average polar angles between $\theta=\pi/2$ radians and $\theta=\pi$ radians.

3. The trap of claim 2 further including an access port passing through said shell in a region located at an angle to said polar axis.

4. The trap of claim 3 wherein said shell comprises a plurality of magnetic segments and wherein each said segment is uniformly magnetized.

* * * * *